United States Patent [19]

Ikeuchi

[11] 4,092,003

[45] May 30, 1978

[54] SPRAY NOZZLE

[76] Inventor: Hiroshi Ikeuchi, 507-7-2 Hiratacho, Ashiyashi, Hyogo, Japan

[21] Appl. No.: 776,368

[22] Filed: Mar. 10, 1977

Related U.S. Application Data

[63] Continuation of Ser. No. 645,958, Jan. 2, 1976, abandoned.

[30] Foreign Application Priority Data

Aug. 14, 1975 Japan ..... 50-99391

[51] Int. Cl.[2] ..... B05B 1/02

[52] U.S. Cl. ..... 239/590

[58] Field of Search ..... 239/461, 463, 468, 469, 239/553, 589, 590; 138/37, 39; 285/179, 183

[56] References Cited

U.S. PATENT DOCUMENTS

| | | | |
|---|---|---|---|
| 1,938,000 | 12/1933 | Wahlin | 239/468 |
| 2,425,817 | 8/1947 | Mosca | 285/179 X |
| 2,550,573 | 4/1951 | Lyman | 239/468 |
| 2,815,248 | 12/1957 | O'Brien | 239/468 |
| 3,072,346 | 1/1963 | Wahlin et al. | 239/463 X |
| 3,304,013 | 2/1967 | O'Brien | 239/468 |

FOREIGN PATENT DOCUMENTS

| | | | |
|---|---|---|---|
| 1,628,813 | 7/1970 | Germany | 239/468 |
| 483,576 | 8/1953 | Italy | 285/179 |

*Primary Examiner*—John J. Love
*Assistant Examiner*—Andres Kashnikow

[57] ABSTRACT

A spray nozzle having an inlet passage and an outlet passage in the form of the letter L, including a connecting chamber situated at the intersection of the axes of said two passages, said chamber communicating with said inlet passage by a bore substantially co-axial of said inlet passage and having a bottom down-streamly raised preferably in the range of 10° to 30°, so as to produce a full conical shaped spray pattern with equal spray density and the minimum possibility of clogging trouble.

1 Claim, 6 Drawing Figures

SPRAY NOZZLE

Figure 1A:
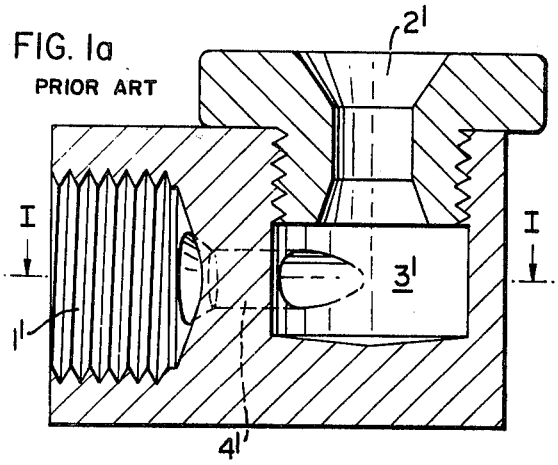
FIG. 1a PRIOR ART
Figure 1B:
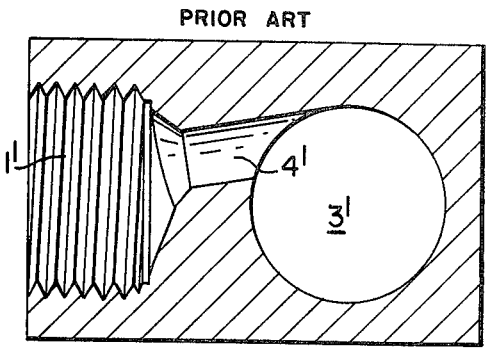
FIG. 1b PRIOR ART
Figure 1C:
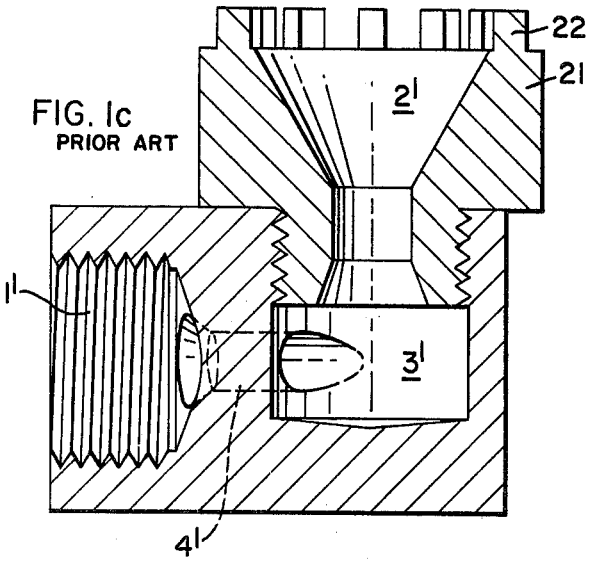
FIG. 1c PRIOR ART
Figure 1D:
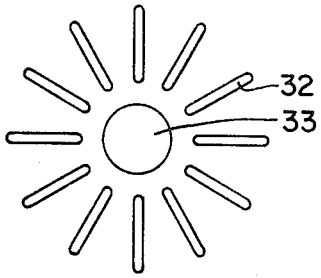
FIG. 1d PRIOR ART

The present application is a continuation application of my copending U.S. patent application Ser. No. 645,958, filed Jan. 2, 1976, now abandoned.

This invention relates to a spray nozzle for spraying a liquid in a full conical shaped pattern. More particularly, the present invention relates to a spray nozzle capable of spraying a liquid in the form of a full cone with equal density and the reduced possibility of clogging trouble.

In general, a liquid can be sprayed in two different patterns: a hollow conical pattern and a full conical pattern. In addition, a spray nozzle may be of two different types: a straight type in which the inlet and outlet passages are aligned co-axially of the nozzle body and an L-shaped nozzle which has an L-shaped arrangement of the inlet and outlet passages. This L-shaped spray nozzle is of particular advantage when it is used in a place where it is desired that the nozzle tip is maintained upwardly or downwardly with respect to the direction of a liquid supply. A further advantage is that this type of nozzle reduces the possibility of clogging trouble by virtue of the minimum number of liquid passages. With these advantages an L-shaped spray nozzle has come into wide use in the industry, which will be more particularly described hereinafter. However, the spray pattern of an L-shaped nozzle is normally a hollow conical shape, and it cannot avoid disadvantages derived from this spray pattern. For example, its spray application is uneven on an object and, as described below, this is a fatal defect for particular industrial fields. Therefore, in order to solve this problem, a good deal of effort has been made to improve an L-shaped spray nozzle without changing its L-shaped construction, but new problems of clogging and unequal density have been encountered.

The present invention is concerned with improvements in such an L-shaped spray nozzle, and has for its object to provide an L-shaped nozzle retaining all advantages characteristic of this type and having additional merits that its spray pattern is a full conical shape with equal spray density and a reduced possibility of clogging trouble.

Figure 2:
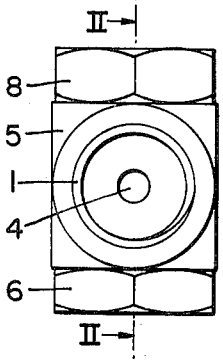
Figure 3:
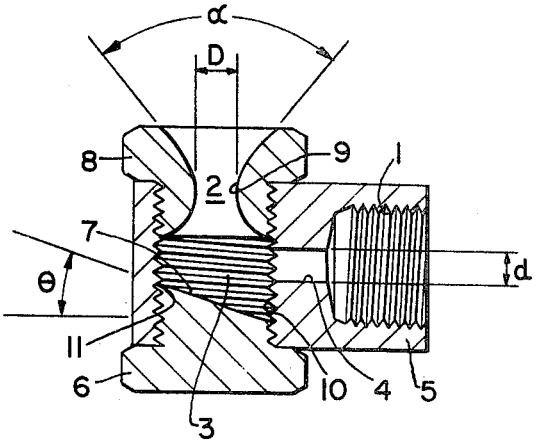

The present invention will be more particularly described by way of example, with reference to the drawings, in which:

In the drawing:

FIGS. 1(*a*) to 1(*d*) show prior art L-shaped spray nozzles;

FIG. 2 is a front view of a spray nozzle according to the present invention; and FIG. 3 is a sectional side view of the spray nozzle illustrated in FIG. 2.

In order to explain the background of the present invention, reference will be more particularly made to a typical example of an L-shaped nozzle known in the art, shown in FIGS. 1 (*a*) and (*b*). This nozzle represents prior art L-shaped nozzles. Although they are slightly different from each other, they are identical in the fundamental structure that the liquid inlet passage 1' and the outlet passage 2' intersect substantially at right angles having a whirling chamber 3' situated therebetween, as best illustrated in FIG. 1 (*a*). An additional common structural feature is that the liquid communicating passage 4' is extended tangentially to the whirling chamber 3' as illustrated in FIG. 1 (*b*) so as to introduce a liquid tangentially into the chamber, thereby enabling the same to whirl therein. In this way the whirling liquid hits the bottom of the chamber 3' and is accelerated to go up the outlet passage 2'. The ejected liquid takes a hollow conical form. As evident from this fundamental construction the L-shaped nozzle has an advantage that is has the least possibility of clogging trouble by virtue of the minimum number of liquid passages. A further advantage is that the nozzle tip can be pointed upwardly or downwardly with respect to the direction of liquid supply. Being safe from clogging trouble is especially advantageous in using the nozzle in area where a pure water cannot be expected, such as iron works and painting factories. This is one of the main reasons for its having come into wide use.

However, as stated above, the spraying pattern produced by an L-shaped nozzle is a hollow conical shape, which is derived from its L-shaped construction enabling a liquid to be tangentially introduced into the whirling chamber. It is commonly known that when whirled the flying liquid naturally forms a hollow conical shape. But a spary of this pattern is not suitable for some applications; for example, for cooling a hot iron with a water spray, where it is essential to avoid an unequal spreading of water on the surface thereof, in case its forming structure is adversely affected. In such cases, therefore, to avoid an unequal spray there is no choice but to use a straight type of nozzle for its full conical spray. If an L-shaped nozzle could be used for such applications, a clogging trouble would be minimized, which, as stated above, is characteristic of this type.

In order to meet this demand of the industry a great deal of effort has been made so as to enable an L-shaped nozzle to produce a full conical shaped spray pattern, one of which is illustrated in FIG. 1 (*c*). The illustrated embodiment is the same in internal construction as the nozzle shown in FIG. 1 (*a*) and (*b*), but is different in that the former embodiment is provided with a mouthpiece 21 and teeth 22, wherein the mouthpiece has a liquid passage 2' communicating with the whirling chamber 3'. Thus the whirling liquid crashes against the teeth 22 to break into fine drops, thereby producing an apparent full conically shaped pattern. The actual shape is not fully conical, however, which is demonstrated by the projected pattern shown in FIG. 1 (*d*). As seen therefrom, the distribution of liquid is very unequal with dense portions 32 and 33. The dense portions 32 come into being in the same numbers as the teeth 22. The defect of unequal spraying is fatal with a spray nozzle, even if it retains all advantages characteristic of an L-shaped nozzle.

A further improvement has been proposed. The proposed embodiment includes a whirler in the outlet passage of an L-shaped nozzle so as to produce a full conical shaped spray pattern. However, a whirler is normally provided with many narrow liquid passages, which tends to cause clogging troubles. Consequently, the advantage of a full conical shaped spray pattern is offset by the disadvantage of frequent clogging troubles.

The present invention has overcome the problems encountered by the prior art nozzles by providing an L-shaped nozzle whose spray pattern is a full conical shape, retaining all advantages of this type and having additional advantages of an equal spray density and the minimum possibility of clogging trouble.

A spray nozzle according to the present invention is made up of a main body 5, an externally threaded member 6 and an upper externally threaded member 8, the last-mentioned two members having hexagonal heads for turning the same, respectively. Internally, the spray nozzle is provided with a liquid inlet passage 1 and a liquid outlet passage 2 with their axes intersecting at right angles, and at the intersection there is provided a connecting chamber 3, thereby enabling a supplied liquid to change its direction ninety degrees, that is, upwardly or downwardly with respect to the direction of the liquid supply, depending upon which way the nozzle tip is pointed. According to the present invention one of the structural features lies in a communicating passage 4 connecting between the connecting chamber 3 and the inlet passage 1. In the known L-shaped spray nozzle this communicating passage is extended from the inlet passage tangentially to the whirling chamber, so as to effect the whirling motion of a liquid introduced therein. In contrast, the communicating passage 4 is provided coaxially of the inlet passage 1. Alternatively, according to another aspect of the present invention the communicating passage can be eccentric of the inlet passage in a particular range. As a result, no whirling motion is caused in the connecting chamber 3. The connecting chamber 3 has a bottom or floor 7 which is upwardly inclined in the downstream direction and meets the opposite side wall. The rising angle $\theta$ is preferably in the range of 10° to 30°. The highest point 11 of the raised bottom 7 is preferably situated directly in front of the opening of the communicating passage 4, but the angular displacement of 30° is allowable as demonstrated by an example below. When a liquid is introduced into the inlet passage 1 from a source it is forced into the narrowed passage 4 and hits against the raised bottom 7 on its way up to the outlet passage 2. In this way the liquid is sprayed through the opening of the outlet passage 2, in the course of which the rushing liquid is guided by the curved side wall 9. In order to facilitate it the outlet passage 2 is first converged and then diverged towards the end opening, wherein the diameter of the converged portion is indicated by letter D. The size of D is decided in accordance with a desired spraying strength. The dimension and size of $d$, D, $\theta$, and $\alpha$ are as follows:

EXAMPLE (1)

$d$ . . . 5.1 mm
D . . . 6.0 mm
$\theta$ . . . 15°
$\alpha$ . . . 75°

In this example, the central line of d is coincident with the axis of the inlet passage 1, and the highest point 11 of the raised bottom is situated rightly in front of the opening of the communicating passage 4.

EXAMPLE (2)

$d$ . . . 7.1 mm
D . . . 7.3 mm
$\theta$ . . . 20°
$\alpha$ . . . 75°

In this example, the central line of $d$ is displaced by $\frac{1}{4}d$ mm to the left when viewed from the entrance of the inlet passage 1, and the highest point 11 of the raised bottom is likewise displaced by 15° in the clockwise direction from the axis of the communicating passage 4, when viewed from the entrance of the outlet passage 2.

The illustrated embodiment has internal threads on the inner wall surface of the inlet passage 1, but it can be arranged that external threads are provided on the outer cylindrical surface of the main body 5.

As described in the foregoing, the spray nozzle of the present invention can spray a liquid in the pattern of a full cone, irrespective of its L-shaped construction. In addition, it retains all other advantages characteristic of this type of nozzle, particularly the reduced possibility of clogging troubles and the capability of directing the spray discharge upwardly or downwardly with respect to the direction of a liquid supply. A further advantage is its equal spraying density. Unlike a known L-shaped spray nozzle including a whirler, the construction is simplified, thereby resulting in the reduced production cost.

I claim:

1. A spray nozzle having a casing forming inlet and outlet passages having intersecting axes at right angles to each other, said casing forming a connecting chamber between said passages, a ramp formed in said connecting chamber having a surface which rises downstream from and relative to said inlet passage, said inlet passage having a narrowed throat section relative to and adjacent said connecting chamber, said throat section having an axis generally coincident with the main axis of said inlet passage, said outlet passage having a narrowed throat section relative to said connecting chamber followed by a flaring section to form a fully conically shaped spray pattern, said ramp forming an angle which is between 10 and 30° relative to the axis of said inlet passage.

* * * * *